US006055753A

United States Patent [19]

Sondericker, III

[11] Patent Number: 6,055,753

[45] Date of Patent: May 2, 2000

[54] MEDIA SCROLL, ASSOCIATED METHOD, AND MEDIA DISPLAY ASSEMBLY THEREFOR

[75] Inventor: John Herbert Sondericker, III, Colorado Springs, Colo.

[73] Assignee: Wybron, Inc., Colorado Springs, Colo.

[21] Appl. No.: 09/141,208

[22] Filed: Aug. 27, 1998

[51] Int. Cl.[7] ..... G09F 11/18

[52] U.S. Cl. ..... 40/471; 40/467; 40/472

[58] Field of Search ..... 40/471, 472, 518, 40/524, 467; 428/61

[56] References Cited

U.S. PATENT DOCUMENTS

| | | | |
|---|---|---|---|
| 1,887,803 | 11/1932 | Denslow | 40/472 |
| 3,336,687 | 8/1967 | Fontaine | 40/472 |
| 3,780,458 | 12/1973 | Jacoby et al. | 40/471 |
| 4,839,206 | 6/1989 | Waldenberger | 428/40 |
| 5,130,185 | 7/1992 | Ness | 428/40 |
| 5,348,793 | 9/1994 | Stettner | 428/211 |
| 5,353,534 | 10/1994 | Fassauer et al. | 40/524 |
| 5,354,589 | 10/1994 | Wass | 428/61 |
| 5,488,791 | 2/1996 | Boni | 40/471 X |
| 5,597,994 | 1/1997 | Hornung | 235/375 |
| 5,606,814 | 3/1997 | Szywalla et al. | 40/471 |
| 5,678,333 | 10/1997 | Aiken, Sr. | 40/471 X |
| 5,809,677 | 9/1998 | Wamser et al. | 40/471 |

*Primary Examiner*—Brian K. Green
*Assistant Examiner*—Andrea Chop
*Attorney, Agent, or Firm*—Robert H. Kelly; Holland & Hart LLP

[57] ABSTRACT

A media scroll, and an associated method, formed of a plurality of media frames, in which the media scroll is formed of any selected number of media frames. A media display assembly of which the media scroll forms a portions supportively displays a media frame, or a sequence of media frames, at a display position. The media scroll is formed in a manner permitting substitution of media frames and permits addition of additional media frames thereto.

10 Claims, 2 Drawing Sheets

MEDIA SCROLL, ASSOCIATED METHOD, AND MEDIA DISPLAY ASSEMBLY THEREFOR

The present invention relates generally to a manner by which to supportively display a media frame, selected from a plurality of media frames. More particularly, the present invention relates to a media scroll, and an associated method, comprising a plurality of media frames of which a selected media frame is scrolled to be supportively displayed at a display position. The media scroll is formed in a manner which advantageously facilitates substitution of media frames out of an into the media scroll. Successive ones of the media frames of the media scroll are connected together in a manner which permits significant numbers of media frames, together forming the media scroll, to be scrolled about a spindle. The present invention further relates to a media display apparatus for supportively displaying a selected media frame, or series of media frames, of the media scroll at the display position.

Media frames are positioned in an end-to-end manner, and two-sided adhesive strips are used to affix adjacent ones of the media frames together to form the media scroll. When a particular media frame is to be removed from the media scroll, and substituted with a substitute media frame, a release force is applied to the media frame to release the media frame out of its affixation to the adhesive strip. The substitute media frame is affixed in position by way of the adhesive strip. The adhesive strips used to affix together the adjacent media frames are relatively thin, to be of thicknesses substantially similar to the thickness of the media frames, media scrolls of increased lengths, relative to the lengths of existing media scrolls are possible.

In one implementation, the media frames are formed of display images, such as advertisements, and a media scroll formed therefrom is supported at a display assembly. The media scroll is caused to be scrolled to position successive ones of the media frames at a display position to display the design images thereat.

BACKGROUND OF THE INVENTION

Display of media frames is widely utilized for purposes of announcing and advertising. When the media frame is formed of a design image printed upon a translucent substrate and is thereafter positioned to be backlighted by a high-intensity lamp, the appearance of the image forms a visually-significant display.

Media display apparatus is available which permits a selected one of a plurality of media frames to be displayed at the media display apparatus. When the media frames are connected together to form a media scroll, successive ones of the media frames can be scrolled into position at a display position of the media display apparatus. Successive advertising displays associated with successive ones of the media frames can be scrolled into position at the display position of the media display apparatus according to a sequencing scheme.

It is sometimes desirable to change the media frames which together form the media scroll. One existing media scroll provides for substitutability of media frames by the use of a substrate including a series of pouches. A media frame is insertable into the media pouch to be supported thereat. When a media frame is to be substituted with a substitute media frame, the media frame is removed out of the supportive pouch, and a substitute media frame is inserted therein. To form a pouch, the substrate must have two layers, and such a requirement requires the substrate to be relatively thick. Also, this type of media scroll is not easily amenable to an increase in its length to increase the number of media frames of which it is formed.

Another type of media scroll utilizes Velcro (™) swatches to affix together adjacently-positioned media frames concatenated together in an end-to-end arrangement. A media scroll formed in this matter also permits substitutability of the media frames of which the media scroll is formed. However, due to the relative thickness of the Velcro (™) swatches, this type of media scroll is also limited in its length as only a limited number of media frames, connected together by the Velcro (™) swatches, can be scrolled about a spindle of the display apparatus.

A media scroll which provides for substitutability of the media frames of which the media scroll is formed but which is less susceptible to length restrictions due to the thickness of the media scroll would be advantageous.

It is in light of this background information related to media display apparatus, and media scrolls therefor, that the significant improvements of the present invention have evolved.

SUMMARY OF THE INVENTION

The present invention, accordingly, advantageously provides a media scroll formed of a plurality of media frames, an associated method, and a media display assembly for displaying a selected media frame of the media scroll at a display position. The selected media frame of the media scroll is scrolled into position at the display position, for example, by a drive mechanism forming a portion of the media display assembly.

The media scroll is constructed to permit substitutability of the media frames of which the media scroll is formed. Media frames of the media scroll are positioned in an end-to-end arrangement, and strips of a two-sided adhesive material are positioned between adjacent ones of the media frames. A first of two adjacent media frames is adhered to a backside of a strip of the adhesive material, and the second of two adjacent media frames is adhered to a front face side of the adhesive strip. Successive ones of the media frames are adhered to adhesive strips in analogous fashion, together to form the media scroll.

The strips of the adhesive material are of thicknesses similar to the thicknesses of the media frames. Both the media frames and the strips of adhesive material are flexible to permit scrolling of the media frames about a spindle. Because of the relative thinness of the adhesive strips, the media scroll can generally be of increased lengths relative to conventional media scrolls. That is to say, the characteristics of the adhesive strips permit a significant number of media frames to be connected theretogehter and thereafter scrolled into a rolled configuration.

One or more media frames of the media scroll can be removed therefrom through the application of a sheering force applied to the media frame to release the media frame from its affixation to adjacent media frames. A substitute media frame is thereafter substitutable therefor. Or, the media frame can simply be removed from the media scroll and remaining portions of the media scroll thereafter reconnected by way of the strip of adhesive material. When positioned at a media display assembly of an embodiment of the present invention, the support apparatus of the assembly facilitates removal and replacement of the media frames. Removal and replacement of a media frame is effectuated in a manner which facilitates proper alignment of the adjacent ones of the media frames. Thereby misalignment of the media frames and resultant problems sometimes otherwise associated with scrolling of the media scroll about a spindle are minimized.

In these and other aspects, therefore, a media scroll, and an associated method, is displayable at a media frame display apparatus. A plurality of media frames are positioned in and end-to-end arrangement to define an interface area between adjacent ones of the media frames. Each media frame has a front face surface and a rear face surface. An adhesive strip member is positioned to extend along an interface area defined between the adjacent media frames and to overlap the adjacent media frames. The adhesive strip member has a first face side and second face side. Adhesive material is formed on the first face side of a first adhesive strength, and adhesive material is formed upon the second face side and is of a second adhesive strength. The first face side of the adhesive strip member is affixed to the front face surface of a first of two adjacent media frames. And, the second face side of the adhesive strip member is affixable to the rear face side of a second of the two adjacent media frames. The second of the two adjacent media frames is releasable out of affixation to the second face side of the strip member upon application of a pulling force applied to the second of the two adjacent media frames, thereby to permit removal of the second of the two adjacent media frames and substitution therefor.

A more complete appreciation of the present invention and the scope thereof can be obtained from the accompanying drawings which are briefly summarized below, the following detailed description of the presently-preferred embodiments of the invention, and the appended claims.

DETAILED DESCRIPTION

Figure 1:
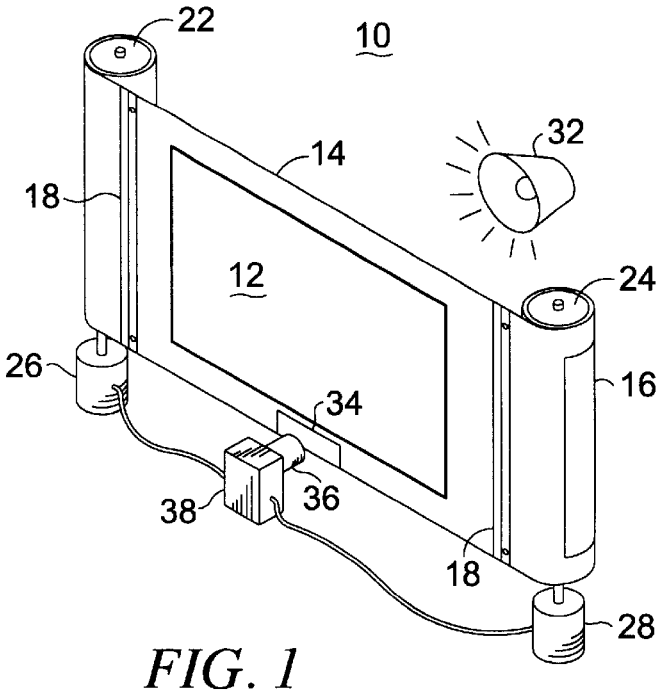
FIG. 1 illustrates a partial functional, partial perspective view of a media display assembly of an embodiment of the present invention.

Referring first to FIG. 1, a media display assembly, shown generally at 10, of an embodiment of the present invention is operable to display a design image, such as the design image 12 formed upon a media frame, here the media frame 14. The design image 12 displayed at the media display assembly 10 is selected from amongst a plurality of design images formed upon a corresponding plurality of media frames which are concatenated together to form a media scroll 16.

Adjacent ones of the media frames 14 are affixed theretogehter by way of strips of two-sided adhesive materials, of which two strips 18 are shown in the figure. The strips 18 releasably affix adjacent ones of the media frames 14. Both the media frames and the strips of adhesive material are flexible to permit scrolling of the media scroll 14 around spindles, here left and right spindles 22 and 24, respectively. End portions of the media scroll 16 are affixed to the respective ones of the spindles 22 and 24. Rotation of the spindles, such as that caused in either the clockwise or counter-clockwise directions by way of the drive mechanisms 26 and 28 cause scrolling of the media scroll 16 in the direction of the rotation of the drive mechanisms. Thereby, the design image of any selected media frame can be caused to be positioned at a display position of the media display assembly. The assembly includes a backlight 32 operable to generate an illumination directed at the design image formed upon the media frame positioned at the display position. Illumination of the design image creates a vivid display of the image formed at the media frame.

A tag member 34 is affixed at a border portion of each of the media frames 14. The tag member 34, in one embodiment, are affixed to the media frames 14 by way of an adhesive material. In another embodiment, the tag members are printed upon the media frames. The tag members 34 are utilized in positioning in selected ones of the media frames 14 at a display position of the assembly 10. In the exemplary implementation, the tag members 34 are formed of light non-transmissive materials whereas other border portions of the media frame 14 are formed of transparent or otherwise light-transmissive materials. The assembly 10 further includes a light transmitter 36 and light detector (hidden from view in the figure) which together form a position sensor. The position sensor assembly is operable to sense the position of the media scroll 16 and the media frames thereof responsive to detection of, or the absence of detection of, light generated by the light transmitter of the position sensor assembly. The detector (not shown) of the position sensor assembly is coupled to a control device 38, such as a processing device or other control apparatus.

The control apparatus 38 is operable, inter alia., to control operation of the drive mechanisms 26 and 28. The controller 38, in one implementation, is operable to sequence a series of media frames and the deigns images formed thereon into the display position of the display assembly 10 according to a selected sequencing scheme. The sequencing scheme may, for instance, be time-dependent and the particular media frame 14 caused to be scrolled into position at the display position of the display assembly responsive to a time-of-day indication.

In an exemplary implementation, the media display assembly is used for announcing menu items at a fast food-type restaurant, and the media frames of the media scroll 16 identify, e.g., selected menu items at different meal times. A first series of media frames identify menu items associated with a first mealtime, e.g., breakfast, and as second series of media frames identify menu items associated with second mealtime, e.g., lunch.

The control apparatus 38 in such an implementation sequences through the first series of media frames during the time period corresponding to the first mealtime and sequences through the second series of media frames during the second mealtime positioning the selected ones of the media frames at the display position for selected dwell periods. And, during a time period in which both menus are served, the control apparatus causes the media frames of both series to be displayed according to a selected sequence.

Figure 2:
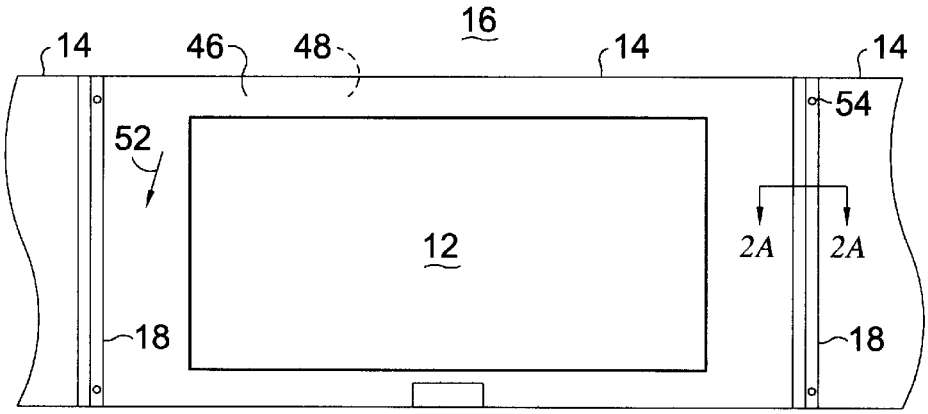
FIG. 2 illustrates an exploded, isolational view of a media frame, together with portions of adjacent media frames of a media scroll of an embodiment of the present invention.

FIG. 2 illustrates a portion of the media scroll 16 of an embodiment of the present invention. Here, one media frame 14 is pictured in its entirety and portions of the two media frames 14 adjacent thereto are shown in the Figure. And, the strips of two-sided adhesive material 18 used to affix the adjacent ones of the media frames together are also shown in the Figure. The arrangement of the strips 18 relative to the media frames is shown in greater detail in the FIG. 2A.

Figure 2A:
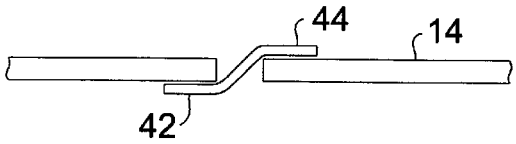
FIG. 2A is a section view taken on the line 2A—2A of FIG. 2.

As shown in FIG. 2A, the left-most (as shown) strip member 18 includes a front side surface 42 and a rear side surface 44. Adhesive material is coated upon both the front and rear side surfaces 42 and 44 of the strip member. In the exemplary implementation, the adhesive material applied to the rear side face 44 of the strip member is of a greater adhesive strength than the adhesive material applied to the front side face of the strip member.

The strip member is positioned in serpentine fashion at the interface between the two media frames 14 such that the rear side face 44 of the strip member abuts against a front face 46 of the left-most (as shown) media frame to be affixed thereto. And, the front side face 42 of the strip member is positioned to abut against a rear face surface 48 of the center-most (as shown) media frame 14 to be affixed thereto.

Substitution of the center-most (as shown) media frame with a substitute media frame is effectuated by applying a pulling force in the direction of the arrow 52 to release the center-most media frame out of the its affixation with the left-most strip 18. A pulling force is also applied to the right-most (as shown) media frame out of its affixation to the right-most (as shown) strip of adhesive material. Thereafter, the center-positioned media frame can be removed and replaced with a substitute media frame. Or, the left-most and right-most (as shown) media frames 14 can merely be connected together by way of the left-most strip 18 of adhesive material. In this manner, therefore, a media scroll 16 of almost any desired length and formed of any desired combination of media frames is formed.

Figure 3:
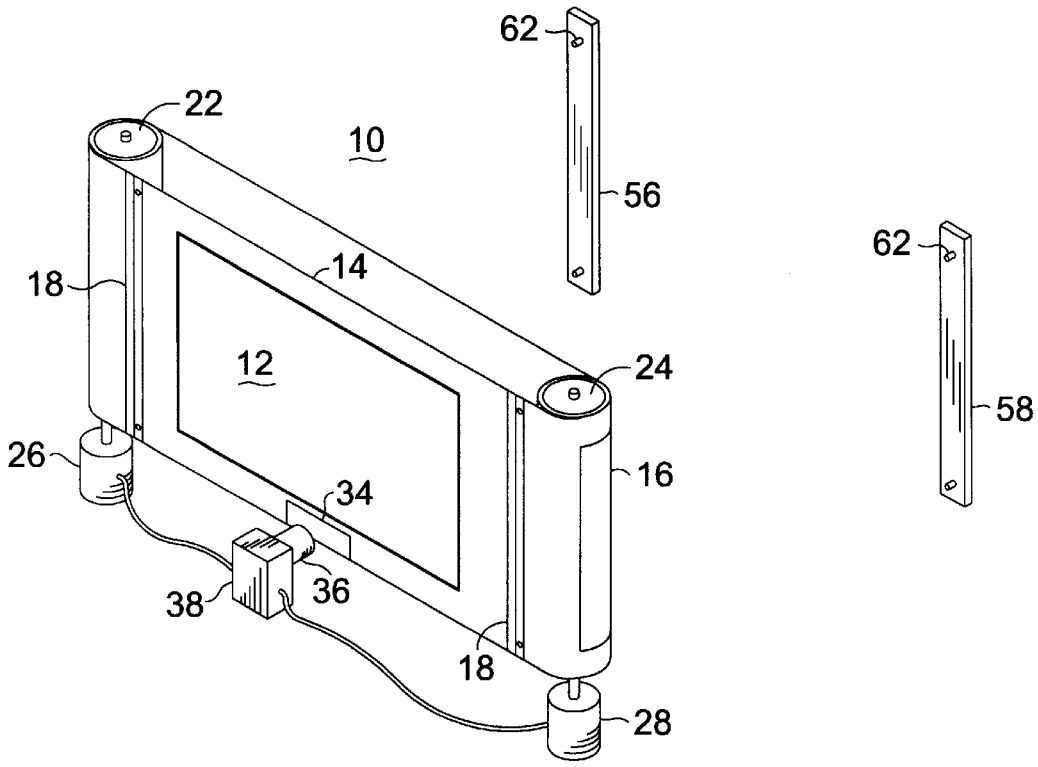
FIG. 3 illustrates a partial functional, partial perspective view of a media display assembly of another embodiment of the present invention.

FIG. 3 illustrates a media display assembly 10 of another embodiment of the present invention. Here, again, the assembly 10 includes a plurality of design images 12 formed upon a corresponding number of media frames 14 which are positioned in an end-to-end arrangement to form a media scroll 16 wherein adjacent ones of the media frames 14 are affixed theretogehter by way of strips 18 of adhesive material.

The assembly 10 is further shown again to include spindles 22 and 24, selectably rotatable by way of actuation of drive mechanisms 26 and 28, respectively. And, tag members 34 are also affixed to each of the media frames 14. The tag members 34 are utilized to determine positioning of the media frames through operation of a positioning assembly including a light sensor 36 operable in manners analogous to the position assembly described with respect to FIG. 1. And, a control mechanism 38 is again shown to form a portion of the assembly 10. The control mechanism is operable, inter alia., to control sequencing of positioning of a selected media frame at a display position to be displayed therefrom. While hidden from view in the figure, a backlight, analogous to the backlight 32 shown in FIG. 1, also forms a portion of the assembly. And, while also not shown, the assembly 10 also includes support structure for supporting the elements of the assembly in position and to define the display position at which selected media frames 14 are cause to be positioned.

In the embodiment of the assembly 10 shown in FIG. 3, opposing ends of the media scroll 6 are connected theretogehter to form an endless loop. Rotation of the spindles 22 and 24 causes scrolling of the endless loop-formed media scroll 16 thereabout.

Bracket members 56 and 58 are further shown in the Figure. Outwardly-extending prongs 62 extend beyond surfaces of the bracket members. The bracket members 56 and 58 are selectably supported by transversely-extending braces (not shown) of support apparatus of the display assembly. The brackets 56 and 58 are utilized during operations to remove media frames out of the media scroll and also when substituting substitute media frames therefor. Subsequent to application of a pulling force to release a selected media frame out of its affixation to a strip of adhesive material, an appropriate corner-positioned aperture 54 (shown in FIG. 2) is positioned such that an appropriate prong member 62 extends therethrough, thereby to support the media frame. The bracket members 56 and 58 form back-support members during subsequent affixation procedures by which a substitute media frame, or the like, is thereafter positioned at the assembly. By supporting the adjacent ones of the media frames by way of appropriate ones of the prong members of the respective brackets members, appropriate alignment of the adjacent media frames is assured. The bracket members 56 and 58 also selectably form portions of the media display apparatus 10 shown in FIG. 1.

Figure 4:
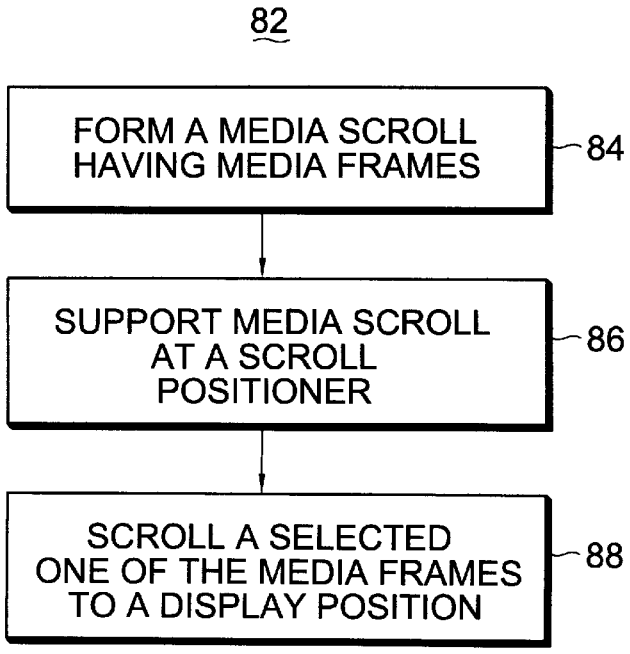
FIG. 4 illustrates a method flow diagram listing the method steps of the method of an embodiment of the present invention.

FIG. 4 illustrates a method, shown generally at 82, of an embodiment of the present invention. Operation of the method 82 displays a selected media frame at a display position. First, and as indicated by the block 84, a media scroll having a first media frame and at least a second media frame positioned in an end-to-end arrangement is formed. The media frames are connected together by way of a strip of adhesive tape.

Next, and as indicated by the block 86, the media scroll is supported at a supportive scroll positioner. And, as indicated by the block 88, the media scroll is scrolled to position a selected one of the media frames at the display position.

The media scroll is formed in a manner which advantageously facilitates substitution of media frames into and out of the media scroll. Because two-sided adhesive strips are sued to affix the adjacent ones of the media frames of the media scroll together, any of the media frames can be released out of its affixation to form a portion of the media scroll by application of a pulling force thereto. Once removed from the media scroll, a substitute media frame is thereafter affixable thereto. The media scroll also permits additional media frames to be added to the media scroll and alternatively, media frames merely to be removed from the media scroll.

The previous descriptions are of preferred examples for implementing the invention, and the scope of the invention should not necessarily be limited by this description. The scope of the present invention is defined by the following claims.

What is claimed is:

1. A media scroll for selectively positioning a media frame relative to a media frame display apparatus comprising:

a plurality of media frames positioned edge to edge, to thereby define a plurality of interface spaces, each interface space being located between two adjacent edges of two adjacent media frames;

each of the media frames having a front surface, a rear surface, and a thickness dimension that extends between the front surface and the rear surface of each media frame;

a plurality of adhesive strip members;

each of the adhesive strip members having a front surface, a rear surface, and a thickness dimension that extends between the front surface and the rear surface of each adhesive strip member;

each of the adhesive strip members being portioned to extend along one interface space;

the rear surface of each adhesive strip member physically engaging a front surface of a first of two adjacent media frames;

the front surface of each adhesive strip member physically engaging a rear surface of a second of two adjacent media frames;

a high strength adhesive material on the rear surface of each of the adhesive strip members;

a low strength adhesive material on the front surface of each of the adhesive strip members; and the second of the two adjacent media frames being releasable out of affixation to the front surface of an associated adhesive strip member upon application of a pulling force being applied to the second of the two adjacent media frames.

2. The media scroll of claim 1 including:

a positioning tag affixed to at least a selected one of the plurality of media frames to facilitate identification of a position of the media scroll relative to the media frame display apparatus.

3. The media scroll of claim 1 including:

a plurality of positioning tags, one positioning tag being affixed to each of the plurality of media frames to facilitate identification of a position of a selected media frame relative to the media frame display apparatus.

4. The media scroll of clam 3 wherein:

each media frame includes generally centrally located image area and an associated bracket area that surrounds the image area; and each media frame includes one of the plurality of positioning tags affixed to the associated bracket area.

5. The media scroll of claim 4 wherein the adhesive strip members and the media frames are flexible, and wherein the thickness of the adhesive strip members is generally similar to the thickness of the media frames.

6. A media frame display assembly for displaying a selected media frame at a display position, comprising:

a media scroll that is movable to position the selected media frame at the display position;

the media scroll comprising a plurality of media frames positioned edge to edge to thereby define a plurality of interface spaces, each interface space being located between two adjacent edges of two adjacent media frames, each of the media frames having a front surface and a rear surface, a plurality of adhesive strip members, each of the adhesive strip members having a front surface and a rear surface, each of the adhesive strip members being positioned to extend along one interface space, the rear surface of each adhesive strip member physically engaging the front surface of a first of two adjacent media frames, the front surface of each adhesive strip member physically engaging the rear surface of a second of two adjacent media frames, a high-strength adhesive material on the rear surface of each of the adhesive strip members, a low strength adhesive material on the front surface of each of the adhesive strip members, and the second of the two adjacent media frames being releasable out of affixation to the front surface of an associated adhesive strip member upon application of a pulling force being applied to the second of the two adjacent media frames; and a scroll positioner supportively engaging the media scroll for moving the media scroll to position the selected media frame at the display position.

7. The media frame display assembly of claim 6 wherein the media scroll includes a first end portion and a second end portion, wherein the scroll positioner comprises a first spindle and a second spindle, wherein the first end portion of the media scroll is coupled to the first spindle and the second end portion of the media scroll is coupled to the second spindle, such that rotation of the first spindle and the second spindles cause movement of the media scroll to position the selected media frame at the display position.

8. The media frame display assembly of claim 6 wherein the media scroll includes a first end portion and a second end portion that are connected together to form a closed loop, wherein the scroll positioner comprises a first spindle and a second spindle, wherein the closed loop is positioned about the first and second spindles such that rotation of the first and the second spindles causes movement of the media scroll to position the selected media frame at the display position.

9. The media frame display assembly of claim 6 further comprising:

a positioning tag affixed to each of the plurality of media frames;

a sensor for detecting a position of a positioning tag that is affixed to the selected media frame; and a controller coupled to the scroll positioner and to the sensor for controlling operation of the scroll positioner to position the selected media frame at the display position.

10. The media frame display assembly of claim 9 wherein the controller is operable to select the selected media frame in accordance with a selection criteria.

* * * * *